US007387692B2

(12) United States Patent
Cao

(10) Patent No.: US 7,387,692 B2
(45) Date of Patent: Jun. 17, 2008

(54) TOOL AND BEARING STEELS

(75) Inventor: Wei-Di Cao, Charlotte, NC (US)

(73) Assignee: ATI Properties, Inc., Albany, OR (US)

( * ) Notice: Subject to any disclaimer, the term of this patent is extended or adjusted under 35 U.S.C. 154(b) by 0 days.

(21) Appl. No.: 11/328,396

(22) Filed: Jan. 9, 2006

(65) Prior Publication Data

US 2007/0160490 A1 Jul. 12, 2007

(51) Int. Cl.
*C22C 38/22* (2006.01)
*C22C 38/24* (2006.01)

(52) U.S. Cl. ..... 148/334; 420/103; 420/111

(58) Field of Classification Search ..... 148/330–334; 420/111, 103–105, 109
See application file for complete search history.

(56) References Cited

U.S. PATENT DOCUMENTS

| | | | |
|---|---|---|---|
| 2,241,187 | A | 5/1941 | De Vries |
| 2,478,723 | A | 8/1949 | Trantin |
| 2,715,576 | A | 8/1955 | Payson et al. |
| 2,753,260 | A | 7/1956 | Payson |
| 2,996,376 | A | 8/1961 | Nehrenberg et al. |
| 3,105,723 | A | 10/1963 | Hamaker |
| 3,113,862 | A | 12/1963 | Harvey et al. |
| 3,144,362 | A | 8/1964 | Bradd |
| 3,198,630 | A | 8/1965 | Tarwater |
| 3,259,489 | A | 7/1966 | Hamaker et al. |
| 3,295,966 | A | 1/1967 | Steven |
| 3,326,675 | A | 6/1967 | Kenneford |
| 3,431,101 | A | 3/1969 | Kunitake |
| 3,492,116 | A | 1/1970 | Kenneford et al. |
| 3,850,621 | A | 11/1974 | Haberling et al. |
| 4,116,684 | A | 9/1978 | Uchida et al. |
| 4,162,157 | A | 7/1979 | Parker et al. |
| 4,168,159 | A | 9/1979 | Schlatter et al. |
| 6,200,528 | B1 * | 3/2001 | Rodney et al. ..... 420/110 |

FOREIGN PATENT DOCUMENTS

| | | |
|---|---|---|
| JP | 401111846 | * 4/1989 |
| JP | 401283349 | * 11/1989 |
| JP | 405302149 | * 11/1993 |

OTHER PUBLICATIONS

English translation of Japanese patent 01-111846, Masayoshi Ikegami et al., Apr. 28, 1989.*

* cited by examiner

*Primary Examiner*—Deborah Yee
(74) *Attorney, Agent, or Firm*—Kirkpatrick & Lockhart Preston Gates Ellis LLP; Patrick J. Viccaro

(57) ABSTRACT

Alloy tool steels of the present invention may be suitable for metalworking tools, bearings, gears, and specialized automotive parts, such as camshafts and lifters. A steel alloy, comprising: by weight, 0.5 to 1% carbon; 0.5 to 2.0% vanadium; 1.0 to 2.0% aluminum; 0.2 to 1.0% silicon; chromium; molybdenum; manganese; and iron. Further embodiments of the alloy tool steel consisting essentially of: by weight, 0.5 to 1% carbon; 0.5 to 1.5% vanadium; 1.0 to 2.0% aluminum; 0.2 to 1.0% silicon; 3.5 to 4.5% chromium; 0.1 to 0.5% manganese; 3.5 to 4.5% molybdenum; less than 0.05% nitrogen and the balance iron. In certain embodiments, the alloy tool steel comprises a ratio of the weight percentage of aluminum to the weight percentage of silicon in the range of 1.7 to 2.2.

33 Claims, 6 Drawing Sheets

TOOL AND BEARING STEELS

UTILITY OF THE INVENTION

The present invention relates to alloy tool steels with improved strength, toughness, and fatigue. Alloy tool steels of the present invention may be suitable for metalworking tools, bearings, gears, and specialized automotive parts, such as camshafts and lifters, for example.

DESCRIPTION OF THE INVENTION

Background

Alloy tool steels are typically complex iron-based alloys of carbon, chromium, vanadium, molybdenum, or tungsten or combinations thereof. In some cases, alloy tool steels may comprise substantial amounts of cobalt. The carbon and alloy contents are balanced at levels to give high hardening response, high wear resistance, high resistance to the softening effect of heat, and good toughness for effective use in industrial cutting operations.

The mechanical and physical properties of alloy tool steels may have great variations based upon the chemical composition. The four most important properties may be considered to be hardness, hot hardness, wear resistance, and toughness. Hardness is measured as the resistance to penetration by a diamond hard indenter, typically measured at room temperature. Hot hardness is a measure of an alloy's ability to retain its hardness at elevated temperatures. Wear resistance is a measure of an alloy's ability to resist loss of mass in sliding, rolling contact abrasion, erosion and other conditions. Toughness is the measure of an alloy's ability to resist fracture. The relative importance of each of these properties depends on the specific application.

The alloying agents and carbon in alloy tool steels will typically form carbide particles during processing. Coarse carbide particles adversely affect the toughness, hardness, and fatigue properties of steels. For example, M50 is a widely used, low-cost, low-alloy high-speed steel containing chromium, molybdenum and vanadium as major alloying elements. Due to the lean alloy content, M50 has a low volume fraction of primary carbides. However, the primary carbide particles are coarse and angular. See FIG. 1. The coarse carbide particles cause the M50 alloy to have a lower toughness.

Additionally, one of the major problems associated with bearing failure is the surface damage by rolling contact fatigue. Among others, two factors may significantly increase the resistance to rolling contact fatigue in alloys. The first factor is hardness of the bearing steel. Studies have shown that there may be an optimum hardness for some bearing steels, such as 52100, but high hardness is preferred for some other bearing steels, such as M50. The second factor is the morphology of primary carbide particles. Typically, contact fatigue failures are initiated in coarse primary carbide particles. As such, coarse, angular-shaped and non-uniformly distributed primary carbide particles may lead to low resistance to rolling contact fatigue. To further improve the contact fatigue resistance, it is desirable to provide an alloy having high hardness and better carbide morphology, such as a carbide morphology consisting of fine, round-shaped and uniformly distributed carbide particles.

Therefore, there exists a need for an alloy tool steel that comprises fine, uniformly distributed carbide crystals. There also exists a need for an alloy tool steel with higher wear resistance, better high temperature capability and equal or even better toughness than M50 with little or no increase in cost.

SUMMARY

An embodiment of the present invention is a steel alloy comprising, by weight, 0.5 to 1% carbon, 0.5 to 2.0% vanadium, 1.0 to 2.0% aluminum, 0.2 to 1.0% silicon, chromium, molybdenum, manganese, and iron. The steel alloy may further comprise 3.5 to 4.5% chromium, 0.1 to 0.5% manganese, and 3.5 to 4.5% molybdenum.

Further embodiments of the alloys of the present invention may have the following composition: 0.8 to 1.0% carbon, 3.7 to 4.5% chromium, 4.0 to 4.5% molybdenum, 1.0 to 1.5% vanadium, 1.0 to 2.0% aluminum, and 0.2 to 1.0% silicon. In specific applications, the embodiment may further comprise a ratio of weight percentage of aluminum to weight percentage of silicon is in the range of 1.7 to 2.2

Additional embodiments of the alloys of the present invention may have the following composition: 0.6 to 0.75% carbon, 3.75 to 4.5% chromium, 3.75 to 4.5% molybdenum, 0.9 to 1.0% vanadium, 1.0 to 2.0% aluminum, and 0.5 to 1.0% silicon.

Further embodiments of the alloys of the present invention may have the following composition: 3.75 to 4.5% chromium, 3.75 to 4.5% molybdenum, 0.50 to 0.60% vanadium, 1.0 to 2.0% aluminum and 0.5 to 1.0% silicon. Preferably, in such embodiments, a ratio of weight percentage of aluminum to weight percentage of silicon is in the range of 1.7 to 2.2.

BRIEF DESCRIPTION OF THE FIGURES

The features and advantages of the present invention may be better understood by reference to the accompanying figures in which.

DETAILED DESCRIPTION OF EMBODIMENTS OF THE INVENTION

Figure 1:
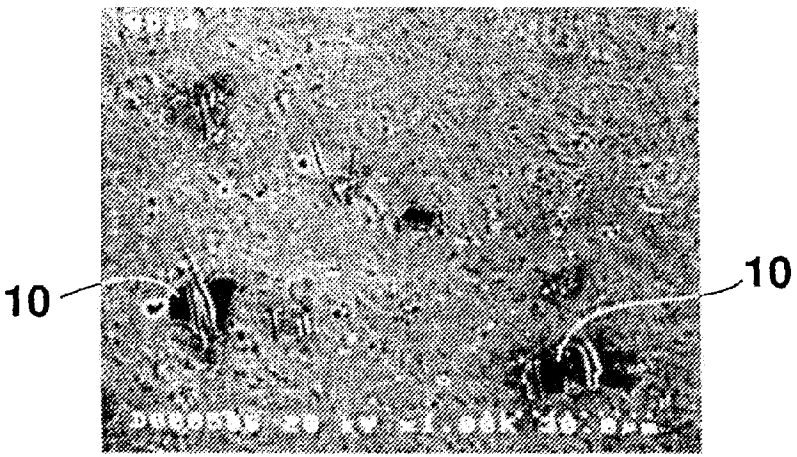
FIG. 1 is a photomicrograph of a typical alloy tool steel having the alloy concentrations of typical M50 alloy tool steel, taken at 1000× magnification showing the presence of coarse, angular carbide particles, some of which are cracked.

The present invention relates to alloy tool and bearing steels. Embodiments of the alloy of the present invention may be suitable for metal working tools, bearings, gears, and automotive parts, including, but not limited to, camshafts and lifters. Conventional tool and bearing steels typically comprise coarse primary carbide crystals and distributions, such as the coarse primary carbides inherent in commercial aircraft bearing steels, for example, M50. The present invention provides alloys and a method of producing alloys having fine, uniform, round primary carbides. The fine, uniform, round primary carbides result in alloys having significantly improved properties. By simple compositional control and at no significant increase in cost, alloys may be produced having improved combination of hardness at ambient and high temperatures, toughness and fatigue resistance.

An embodiment of the present invention is a steel alloy comprising, by weight, 0.5 to 1% carbon, 0.5 to 2.0% vanadium, 1.0 to 2.0% aluminum, 0.2 to 1.0% silicon, chromium, molybdenum, manganese, and iron. The steel alloy may further comprise 3.5 to 4.5% chromium, 0.1 to 0.5% manganese, and 3.5 to 4.5% molybdenum. All concentrations described in percentages refer to weight percentages unless otherwise indicated. In certain embodiments, it may be preferable for the steel alloy of the present invention to have a ratio of weight percentage of aluminum to weight percentage of silicon (% Al/% Si) in the range of 1.7 to 2.2 or, for certain embodiments, the ratio should be in the range of 1.8 to 2.0. In certain embodiments of the alloy of the present invention, the control of the ratio of weight percentage of aluminum to weight percentage of silicon in the above ranges provides the compositional control to provide fine, uniform primary carbides in the steel alloy. The alloys of the present invention, produced by conventional ingot casting technology, have a carbide distribution which approaches that previously possible only if produced by rapidly solidifying powder alloys.

The inventors are the first to demonstrate that the combined addition of silicon and aluminum in defined ratio modifies the structure of the primary carbide of alloy tool steels and improve the tempering resistance at the same time. The combined effects of concentrations of silicon, aluminum, vanadium, and carbon in embodiments of the present invention produces fine, uniformly distributed carbides. The fine, uniformly distributed carbides in embodiments of the present invention may be formed in conventional ingot metallurgy steels.

Embodiments of the alloys of the present invention comprise improvements in both primary carbide structure and mechanical properties. For example, the carbon and vanadium concentrations in certain embodiments are refined to control the nature and quantity of primary carbides for even better performance, depending on applications. Therefore, in certain embodiments, the alloy of the present invention may comprise 0.8 to 1.0% carbon, or for some applications benefiting from higher toughness, the steel alloy may comprise 0.65 to 0.75% carbon. The concentration of vanadium may also be present in the steel alloy of the present invention in the range of 1.0 to 2.0%. The concentration of vanadium may be reduced to within a range of 0.4 to 0.6% vanadium to further refine the mechanical properties and the morphology of the primary carbide particles.

In embodiments of the present invention, the aluminum, silicon, carbon, and vanadium concentrations are different than typical M50 alloys. These concentration differences result in embodiments of the alloy of the present invention having improved the microstructure and mechanical properties when compared to M50. Not wishing to limit the scope of the invention, it is believed that aluminum in the concentration ranges of the present invention modifies the kinetics of conventional alloy tool steel tempering, refines the size of secondary carbide particles precipitated during tempering, and retards the growth of precipitated carbide particles at high temperatures. This results in an increase in the as-tempered hardness and improved tempering resistance in steel alloys of the present invention. Aluminum in combination with silicon may also play a role in the refining of primary carbide particles.

In embodiments of the present invention, silicon in the concentration ranges of the present invention may affect the morphology of primary carbide particles when compared to conventional alloy tool steels. There are three types of primary carbides ($M_2C$, MC and $M_6C$) in M50, the dominant primary carbide is so-called $M_2C$ with the metal, M, being mainly either molybdenum or, to a lesser degree, vanadium. Thermodynamically, $M_2C$ carbide is less stable and will transform into MC, with the metal, M, being mainly vanadium, and $M_6C$ with the metal, M, being molybdenum and iron. Typically, the $M_2C$ carbide particles, in as-cast steel, are coarse, angular carbide particles. During hot working, the coarse, angular carbide particles may be broken up, and the more thermodynamic stable primary carbides, MC and $M_6C$, are formed. Both the physical and thermal processes reduce the size and angularity of the carbide particles. However, hot working is an inefficient process and the transformation of $M_2C$ into MC and $M_6C$ is very sluggish in alloy tool steels, such as M50; therefore, many coarse, angular-shaped $M_2C$ particles survive processing and are thus present in conventional M50. See FIG. 1.

Not wishing to be limited by the proposed mechanism, it is believed that the silicon in combination with aluminum in the concentration ranges of embodiments of the alloy of the present invention may increase the rate of the transformation process of $M_2C$ into MC and $M_6C$ and the efficiency process of breaking of primary particles during hot working. Silicon and aluminum could form Al—Si atom (atmosphere) around secondary carbide particles and effectively retard their growth, and therefore, enhance the tempering resistance of steels of the present invention.

Vanadium is also an important component in the alloys of the present invention. In conventional alloy tool steels, the concentration of vanadium must be balanced to provide a commercially acceptable alloy. For example, raising the concentration of vanadium may increase the quantity of MC and $M_2C$ carbides and, therefore, increase the wear resistance of steel. However, too high a concentration of vanadium may lead to the formation of hard and coarse primary MC particles during solidification, thereby dramatically reducing the resistance to rolling contact fatigue. Therefore, for applications that require a better roller contact fatigue, a lower concentration of vanadium may be preferred. Thus, it may be necessary to balance the concentration of vanadium in order to provide the proper wear resistance and rolling contact fatigue resistance according to the requirements of a specific application.

The concentration of carbon may also directly affect the quantity of primary carbides, and a higher concentration of carbon may be preferred to improve wear resistance. However, as many studies have shown, carbon should be limited to maintain a balance with other alloy elements to most efficiently utilize the expensive alloy elements. Therefore, it is necessary to adjust the concentration of carbon according to the application and concentrations of other alloying elements.

Hardness: Hardness in an as-heat treated state was used to characterize the strength of exemplary alloys of the present invention. Resistance to softening thermal stability at high temperatures was measured by hardness testing after subjecting samples to two hours of heating at 1200° F. A higher hardness after two hours heating indicates the alloy softens more slowly at high temperature and has a higher tempering resistance; therefore, the alloy will have higher high temperature hardness.

Toughness: The toughness of test alloys was evaluated by two tests. The crack initiation resistance of a sample was measured as the energy spent on breaking a sample in an impact test of an unnotched sample, and the fracture toughness was measured as the resistance of alloy to the propagation of existing cracks. The evaluation of both of these properties gives a more complete evaluation of alloy toughness.

Fatigue: The rotating bend fatigue test was used to characterize the fatigue properties of test alloys. Many studies have shown that there is correlation between the fatigue limit obtained by a rotating bend fatigue test and the rolling contact fatigue resistance of alloys. Therefore, a rotating bend fatigue test may give a good indication of not only general fatigue but also of the rolling contact fatigue properties of the exemplary test alloys.

The chemistries of all test alloys are listed in Table 1, including exemplary samples of a prior art alloy, having the alloy concentrations of a typical M50 alloy tool steel, and embodiments of the alloys of the present invention including alloys from Groups I, II, and III.

TABLE 1

Summary of Chemistry of Test Alloys

| Alloy | | Chemistry (wt. %) | | | | | | |
|---|---|---|---|---|---|---|---|---|
| Group | Heat No. | C | Cr | Mo | V | Mn | Si | Al |
| Standard | G889 | 0.83 | 4.04 | 4.05 | 1.04 | 0.29 | 0.19 | 0.02 |
| M50 (Prior Art) | WH83 | 0.83 | 4.15 | 4.11 | 1.00 | 0.24 | 0.22 | 0.01 |
| Group I | G890 | 0.84 | 4.00 | 4.04 | 1.02 | 0.28 | 0.74 | 1.43 |
| | WH88 | 0.83 | 4.15 | 4.11 | 1.00 | 0.24 | 0.82 | 1.59 |
| | VY56 | 0.90 | 4.19 | 4.31 | 1.20 | 0.26 | 0.82 | 1.52 |
| Group II | G897 | 0.71 | 4.00 | 4.10 | 1.04 | 0.28 | 0.77 | 1.43 |
| | G938 | 0.70 | 3.99 | 4.12 | 1.07 | 0.28 | 0.80 | 1.40 |
| | WH87 | 0.68 | 4.08 | 4.11 | 1.00 | 0.24 | 0.81 | 1.57 |
| | VY55 | 0.69 | 4.22 | 4.23 | 0.93 | 0.18 | 0.82 | 1.56 |
| Group III | WH85 | 0.69 | 4.09 | 4.10 | 0.52 | 0.25 | 0.82 | 1.62 |
| | WH86 | 0.90 | 4.10 | 4.12 | 0.49 | 0.24 | 0.82 | 1.57 |

Note:
VY55 and VY56 were 3000 lbs. heat made by vacuum induction melting (VIM)/vacuum arc remelting (VAR), and all of the rest of the heats were 300 lb. heats made by VIM/VAR.

FIG. 1 is a photomicrograph of prior art alloy, having the alloy concentrations of typical M50 alloy tool steel, taken at 1000× magnification. The photomicrograph of FIG. 1 clearly shows the morphology of the coarse primary carbide particles 10 in the prior art alloy tool steels. Such coarse primary carbide particles 10 may contribute to a reduction in resistance to toughness and fatigue properties.

Embodiments of the alloys of the present invention may be divided into three groups by chemistry.

Group I: Embodiments of the alloys of the present invention in Group I may have the following composition: 0.8 to 1.0% carbon, 3.7 to 4.5% chromium, 4.0 to 4.5% molybdenum, 1.0 to 1.5% vanadium, 1.0 to 2.0% aluminum, and 0.2 to 1.0% silicon with Al/Si=1.7-2.2.

The embodiments of the present invention in Group I may have higher concentrations of both silicon and aluminum than the conventional M50 alloy tool steel, while maintaining high concentrations of carbon and vanadium. Embodiments of the alloy of the present invention in Group I have a higher volume fraction of hard primary carbide particles and higher hardness. These properties should result in high wear resistance and high tempering resistance (high temperature performance). See FIG. 5. The concentration of silicon may be adjusted depending upon the requirements of the application. A lower concentration of silicon may lead to an alloy having primary carbides having a more angular shape and, therefore, a higher cutting ability. Embodiments of alloys of Group I may be used for various tooling applications, for example.

Figure 2:
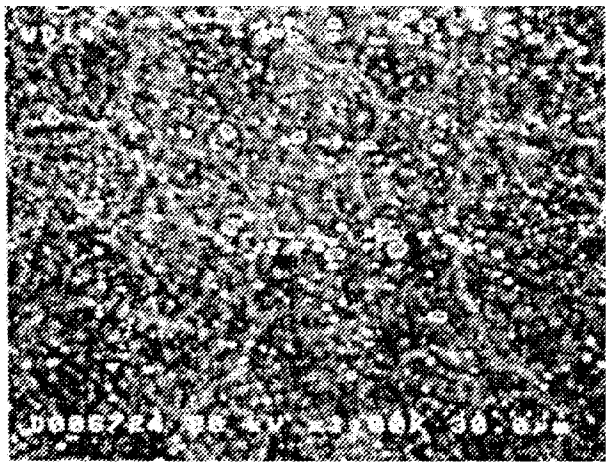
FIG. 2 is a photomicrograph of an embodiment of an alloy tool steel of the present invention having a concentration in the ranges of an alloy of Group I, taken at 1000× magnification.

FIG. 2 is a photomicrograph of an embodiment of an alloy of the present invention from Group I. The microstructure of the alloy of the present invention in FIG. 2 shows the difference in carbide morphology from the microstructure of a conventional steel alloy in FIG. 1. The carbide particles of the alloy of FIG. 2 are clearly finer, rounder, and more uniform than the carbide particles of FIG. 1. The results of the mechanical properties tests for the M50 alloys and embodiments of the alloys of the present invention are listed in Table 2.

TABLE 2

Mechanical Properties of Prior Art and Embodiments of Group I Alloys

| Alloy | | Heat Treatment[1] | | Hardness | Unnotched Impact, | Fatigue Strength, | Thermal Stability,[2] |
|---|---|---|---|---|---|---|---|
| Group | Heat No. | $T_A$, ° F. | $T_t$, ° F. | HRC | ft · lb | ksi | HRC |
| M50 | G889 | 2025 | 1000 | 63.7 | 25 | / | 50.2 |
| | | | 1050 | 61.8 | 38 | 70 | 50 |
| | WH83 | 2000 | 1000 | 63.6 | / | 155 | / |
| | | | 1050 | 62.1 | / | / | / |
| Group I | G890 | 2025 | 1000 | 64.4 | 32 | / | 51.3 |
| | | | 1050 | 63.0 | 39 | 103 | 50.7 |
| | WH88 | 2000 | 1000 | 65.3 | / | 180 | / |
| | | | 1050 | 64.6 | / | / | / |
| | VY56 | 2025 | 1000 | 65.5 | 32 | / | 53.0 |
| | | | 1050 | 64.2 | 35 | / | 52.5 |

[1]$T_A$ is austenitizing temperature and $T_t$ is tempering temperature. All test samples were austenized at $T_A$ for 5 min and then double tempered at $T_t$ for 2 hrs.
[2]Hardness of heat-treated samples after heating 2 hrs at 1200° F. was used to evaluate thermal stability of test alloys.

The difference in alloy composition, see Table 1, between the conventional alloy tool steels and the alloys of Group I provides significant results. After identical heat treatments, the Group I alloys are generally harder, more impact resistant, fatigue resistant and had more resistance to thermal softening. See FIGS. 5, 7(*a*), and 7(*b*)

Figure 3:
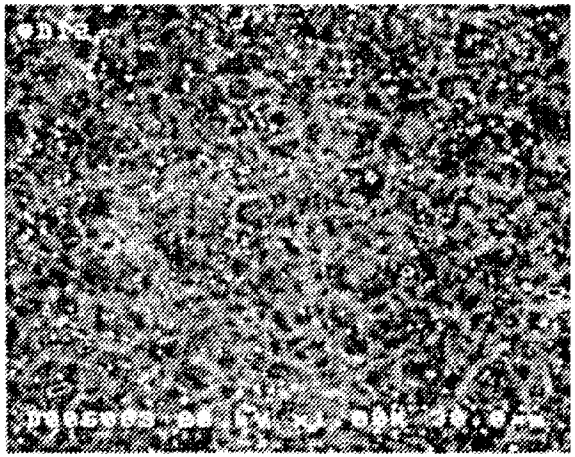
FIG. 3 is a photomicrograph of an embodiment of an alloy tool steel of the present invention having a concentration in the ranges of an alloy of Group II, taken at 1000× magnification.

Group II: Embodiments of the alloys of the present invention in Group II may have the following composition: 0.6 to 0.75% carbon, 3.75 to 4.5% chromium, 3.75 to 4.5% molybdenum, 0.9 to 1.0% vanadium, 1.0 to 2.0% aluminum, and 0.5 to 1.0% silicon. Preferably, in such embodiments, a ratio of weight percentage of aluminum to weight percentage of silicon (% Al/% Si) is in the range of 1.7 to 2.2 or for certain embodiments, the ratio may be in the range of 1.8 to 2.0. Certain embodiments of the Group II alloys may be characterized by higher concentrations of aluminum and silicon. In combination with the higher aluminum and silicon, it may be desirable in certain applications to have concentrations of carbon and vanadium at the lower end of the range in order to further refine the carbide morphology, if desired. As may be seen in FIG. 3, the morphology of the carbide structure of embodiments of the present invention in Group II is significantly better than the conventional alloy tool steel of FIG. 1. The improved carbide structure results in a greatly tougher and more fatigue resistant alloy than the prior art alloy. See Table 3 and FIGS. 6, 7(*a*), 7(*b*), and 8.

TABLE 3

Mechanical Properties of Prior art and Embodiments of Group II Alloys

| Alloy | | Heat Treatment[1] | | Hardness | Unnotched Impact | Fatigue Strength | KIC |
|---|---|---|---|---|---|---|---|
| Group | Heat No. | $T_A$, ° F. | $T_t$, ° F | HRC | ft · lb | ksi | ksi · $in^{1/2}$ |
| Std. M50 | G889 | 2025 | 1000 | 63.7 | 25 | / | 14.9 |
| | | | 1050 | 61.8 | 38 | 70 | 15.7 |
| | WH83 | 2000 | 1000 | 63.6 | / | 155 | / |
| | | | 1050 | 62.1 | / | / | / |
| Group II | G938 | 2025 | 1000 | 63.6 | 71 | / | 16.5 |
| | | | 1050 | 62.0 | 95 | 95 | 18.1 |
| | WH87 | 2000 | 1000 | 63.7 | / | 190 | / |
| | | | 1050 | 62.3 | / | / | / |
| | VY55 | 2025 | 1000 | 64.5 | 49 | / | / |
| | | | 1050 | 63.2 | 62 | / | / |

[1]$T_A$ is austenitizing temperature and $T_t$ is tempering temperature. All test samples were austenized at $T_A$ for 5 min. and then double tempered at $T_t$ for 2 hrs.

The hardness of this group of alloys and quantity of primary carbides was at least equal to that of standard M50 due to the strengthening effect of aluminum and silicon and their effect on carbon activity. This group of alloys may be suitable for various bearing applications, for example.

Group III:

Embodiments of the alloys of the present invention in Group III may have the following composition: 3.75 to 4.5 chromium, 3.75 to 4.5% molybdenum, 0.50 to 0.60% vanadium, 1.0 to 2.0% aluminum and 0.5 to 1.0% silicon. Preferably, in such embodiments, a ratio of weight percentage of aluminum to weight percentage of silicon is in the range of 1.7 to 2.2 or, for certain embodiments, the ratio should be in the range of 1.8 to 2.0.

Figure 4:
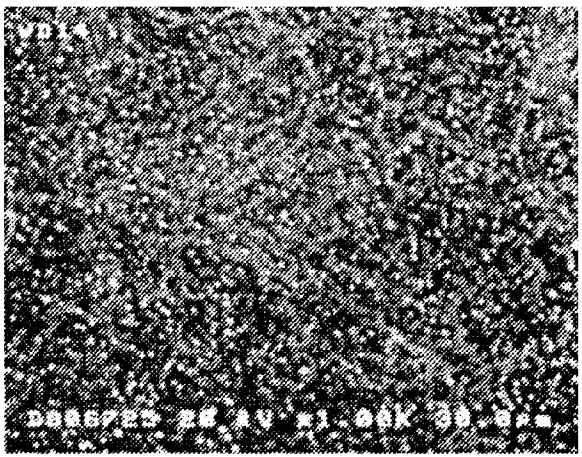
FIG. 4 is a photomicrograph of an embodiment an alloy tool steel of the present invention of an alloy tool steel having a concentration in the ranges of an alloy of Group III, taken at 1000× magnification.

Embodiments of the Group III alloys of the present invention of alloys may have concentrations of carbon and vanadium in a lower range than the prior art M50 alloy, while the aluminum and silicon are in greater concentrations. As may be seen in FIG. 4, the morphology of the carbide structure of an embodiment of the present invention in Group III is significantly finer and rounder than the carbide structure of the conventional alloy tool steel of FIG. 1. The improved primary carbide structure in embodiments of the present invention in Group III contributes improved hardness, fatigue resistance and toughness. See Table 4 and FIGS. 5, 6, 7(*a*), and 8.

TABLE 4

Mechanical Properties of Prior Art and Embodiments of Group III Alloys

| Alloy | | Heat Treatment[1] | | Hardness | Unnotched Impact, | Fatigue Strength, | $K_{IC}$ |
|---|---|---|---|---|---|---|---|
| Group | Heat No. | $T_A$, ° F. | $T_t$, ° F. | HRC | Ft · Lb | ksi | Ksi · $in^{1/2}$ |
| Std. M50 (Prior art) | G889 | 2025 | 1000 | 63.7 | 25 | / | 14.9 |
| | | | 1050 | 61.8 | 38 | 70 | 15.7 |
| | WH83 | 2000 | 1000 | 63.6 | / | 155 | / |
| | | | 1050 | 62.1 | / | / | / |
| Group III | WH86 | 2000 | 1000 | 64.8 | / | / | / |
| | | | 1050 | 64.2 | / | / | / |
| | WH85 | 1950 | 1000 | 64.7 | 46 | 190 | 18.0 |
| | | | 1050 | 63.0 | 55 | / | 22.0 |

[1]$T_A$ is austenitizing temperature and $T_t$ is tempering temperature. All test samples were austenized at $T_A$ for 5 min and then double tempered at $T_t$ for 2 hrs.

Embodiments of the Group III alloys have high hardness while having a lower volume fraction of carbides. Embodiments of the Group III alloys of the present invention may be suitable for use as bearing applications that require very high rolling contact fatigue resistance and for tools requiring high toughness and fatigue properties, for example.

Figure 5:
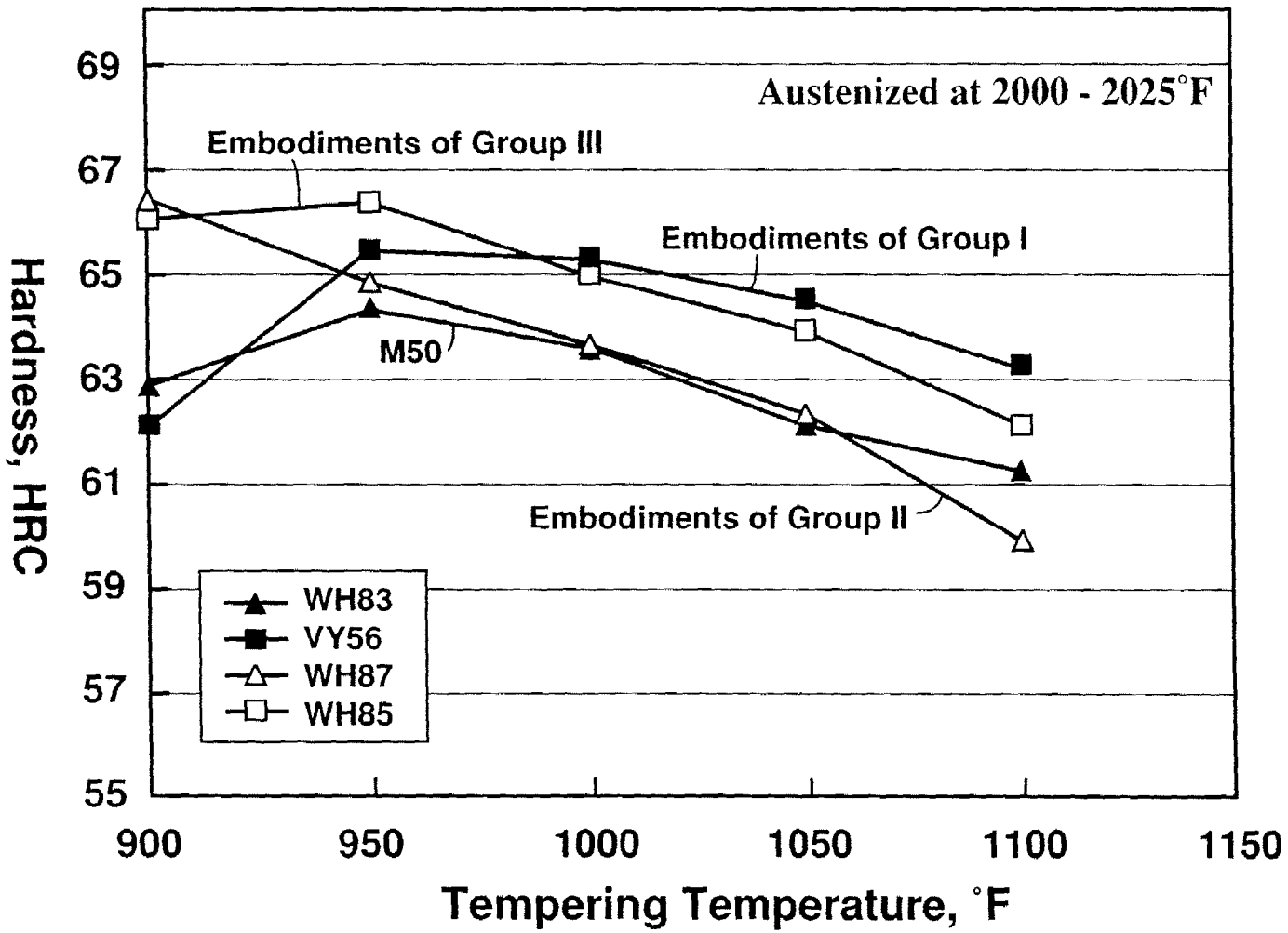
FIG. 5 is a graph of the hardness of a typical alloy tool steel having the alloy concentrations of typical M50 and embodiments of alloy tool steels of the present invention having alloy concentrations in the ranges of alloys in Groups I, II, and III as a function of tempering temperature.
Figure 6:
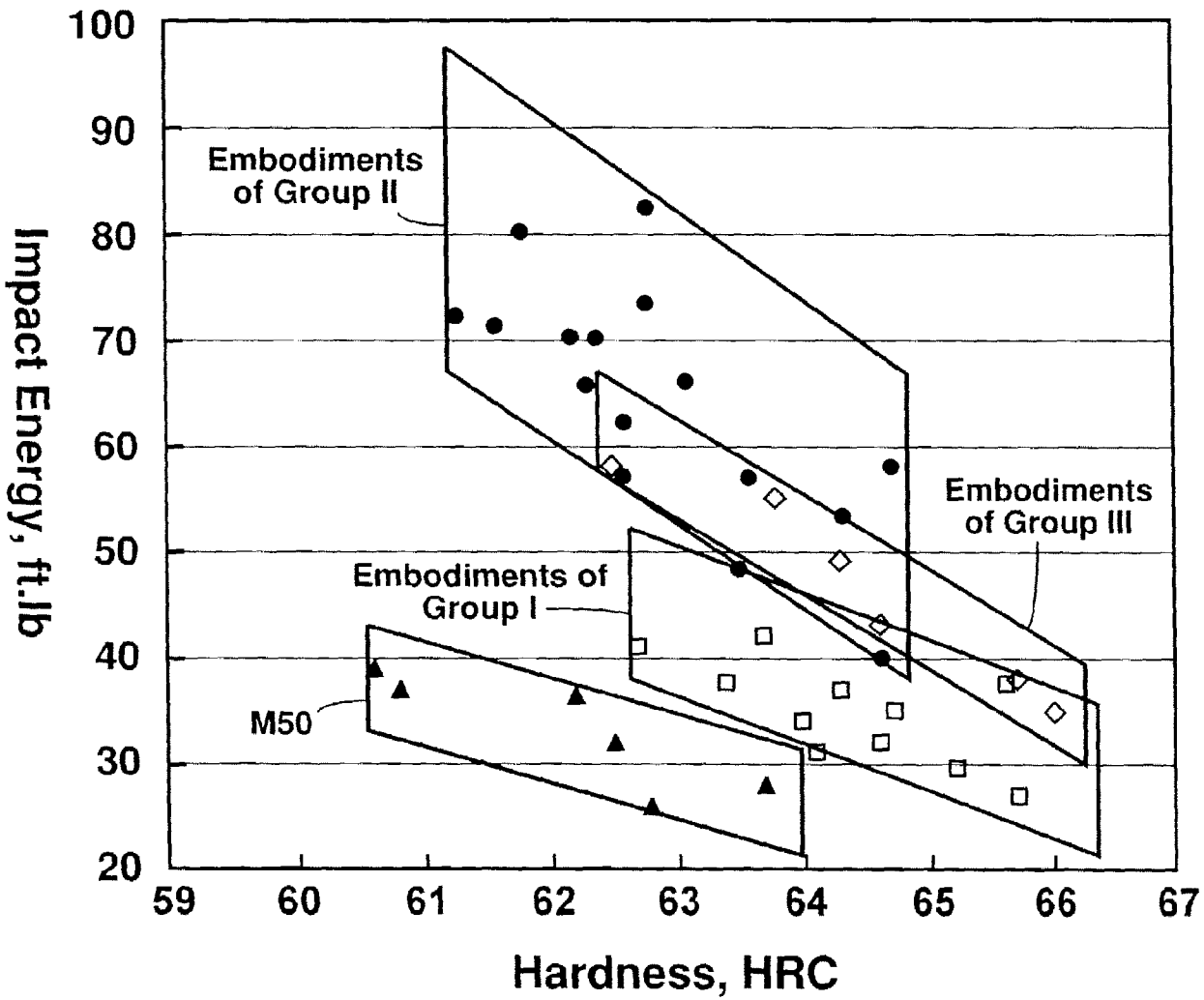
FIG. 6 is a graph of the impact energy of a typical alloy tool steel having the alloy concentrations of typical M50 and embodiments of alloy tool steels of the present invention having alloy concentrations in the ranges of alloys in Groups I, II, and III as a function of hardness.
Figure 7A:
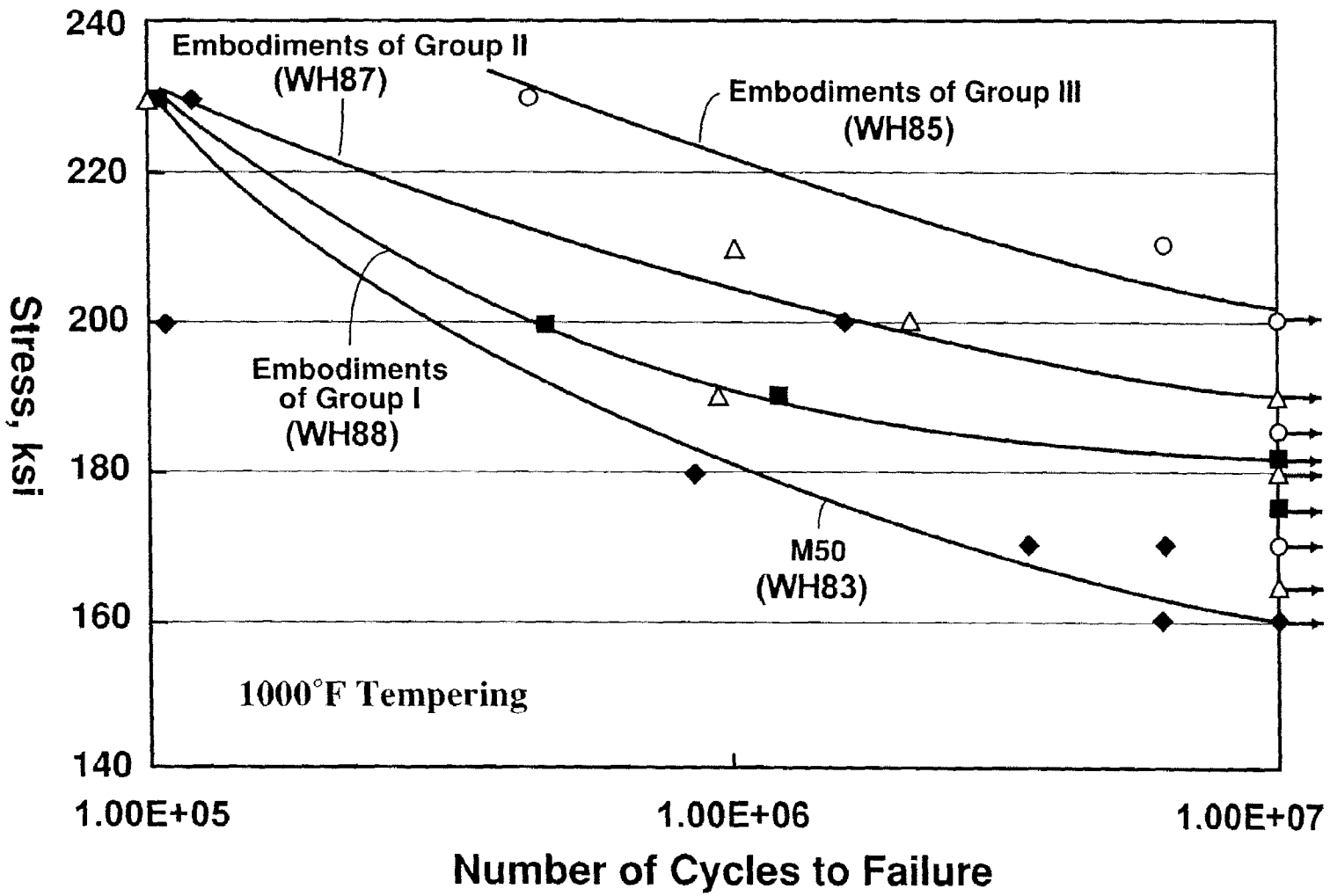
FIGS. 7(*a*) and 7(*b*) are graphs of the rotating bend fatigue curves of a typical alloy tool steel having the alloy concentrations of typical M50 and embodiments of alloy tool steels of the present invention having alloy concentrations in the ranges of alloys in Groups I, II, and III.
Figure 7B:
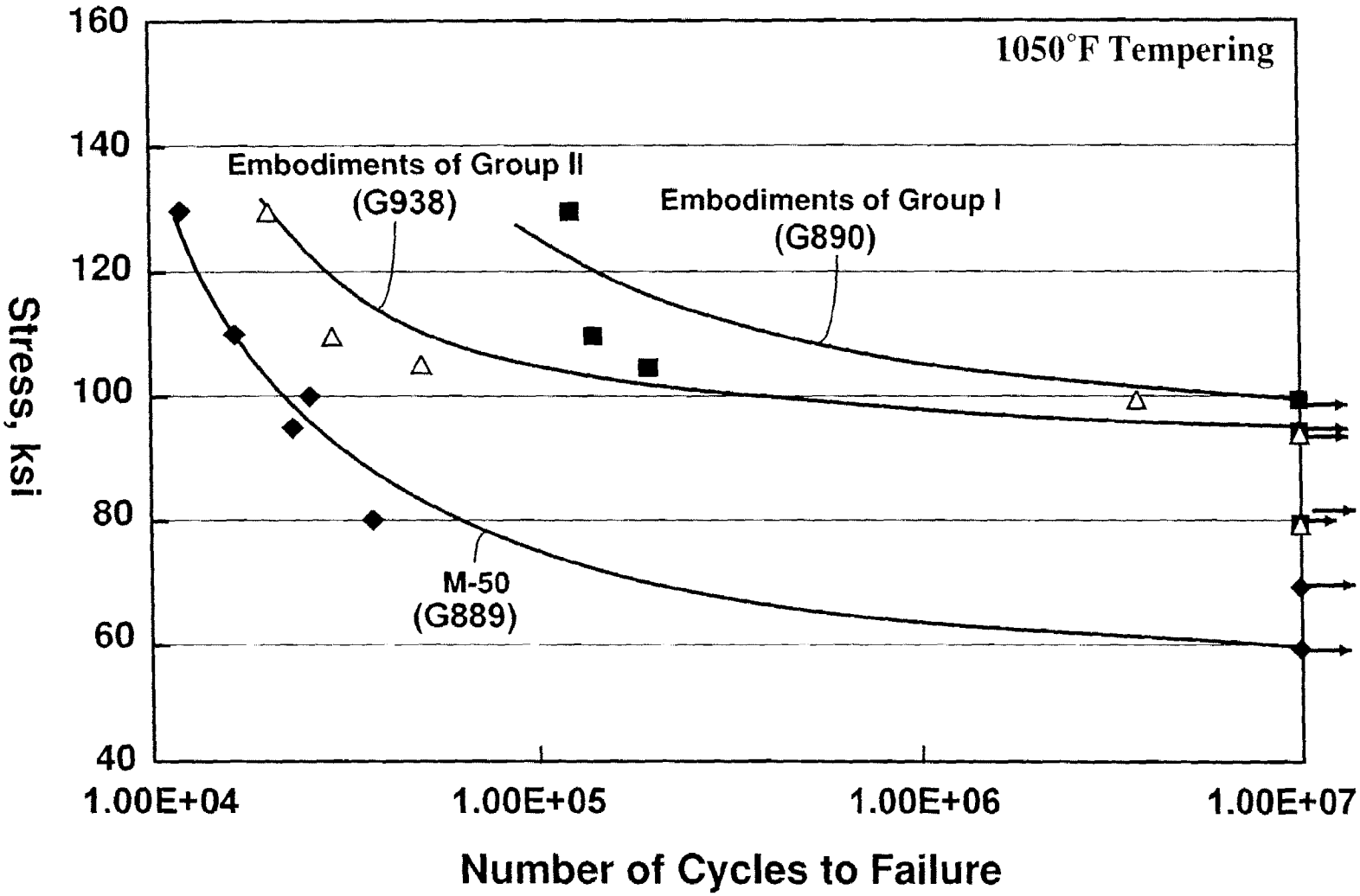
Figure 8:
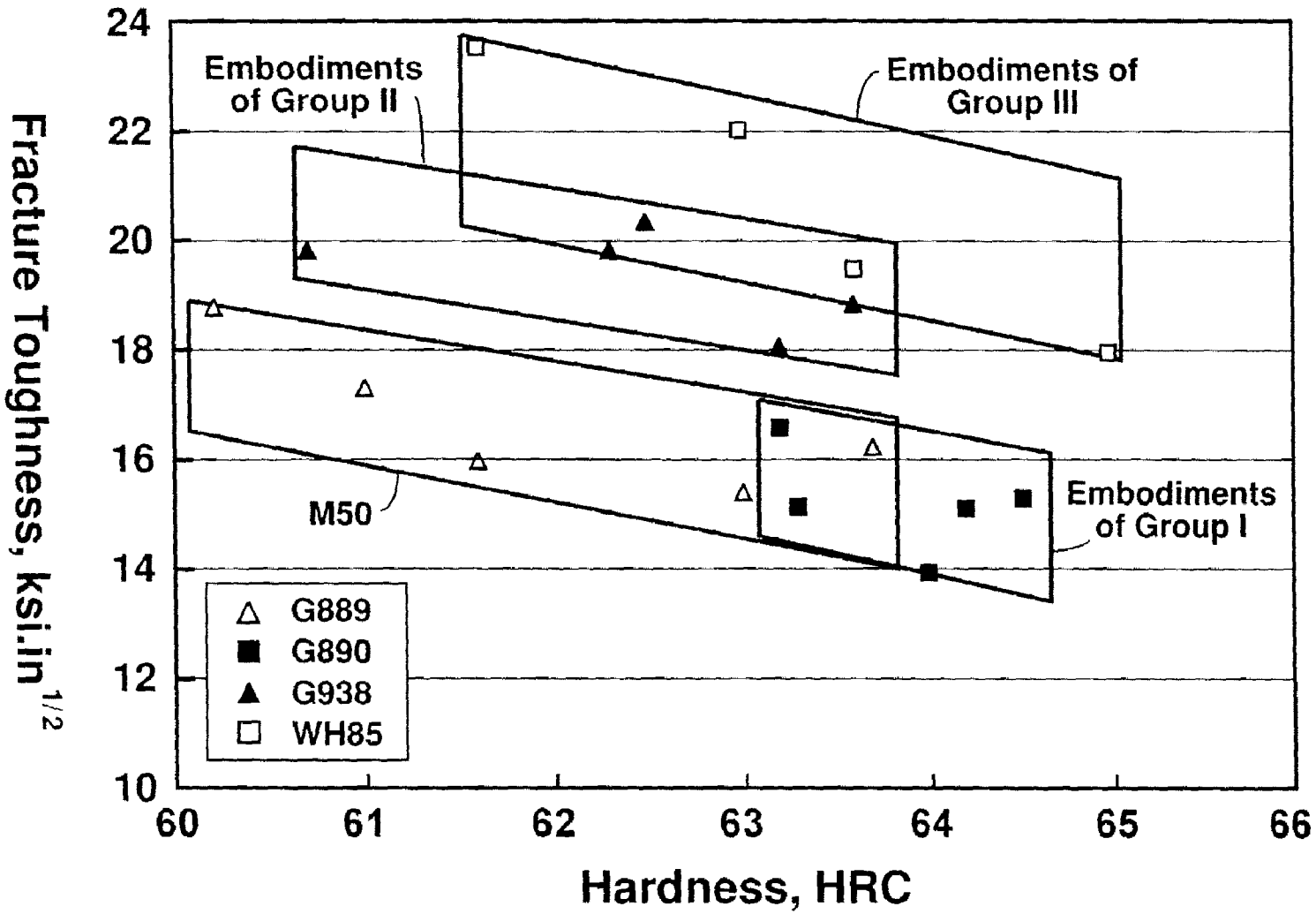
FIG. 8 is a graph of the fracture toughness of a typical alloy tool steel having the alloy concentrations of typical M50 and embodiments of alloy tool steels of the present invention having alloy concentrations in the ranges of alloys in Groups I, II, and III as a function of hardness.

FIGS. 5, 6, 7(*a*) and 7(*b*) are graphs of the mechanical properties of embodiments of alloys of Groups I, II, and III of the present invention and a prior art alloy, M50. Specifically, FIG. 5 is a graph of the hardness of the alloys as a function of tempering temperature. FIG. 6 is a graph of the impact energy of test alloys as a function of hardness. FIGS. 7(*a*) and 7(*b*) are graphs of the rotating bend fatigue curves of embodiments of the present invention and the prior art alloy, M50. The fracture toughness of test alloys is shown in FIG. 8 as a function of hardness. The microstructures of test alloys are shown in FIGS. 1 to 4. The improvement in all of these properties in the invented alloys over prior art alloy, M50, is clearly shown in each of these figures.

The reader will appreciate the foregoing details and advantages of the present invention, as well as others, upon consideration of the following detailed description of embodiments of the invention. The reader also may comprehend such additional details and advantages of the present invention upon making and/or using the stainless steels of the present invention.

The invention claimed is:

1. A steel alloy, comprising: by weight,
0.5 to 1% carbon;
0.4 to 2.0% vanadium;
1.4 to 2.0% aluminum;
0.2 to 1.0% silicon;
3.5 to 4.5% chromium;
3.5 to 4.5% molybdenum;
0.1 to 0.5% manganese; and
iron, wherein the ratio of weight percentage of aluminum to the weight percentage of silicon is in the range of 1.7 to 2.2.

2. The steel alloy of claim 1, wherein the ratio of weight percentage of aluminum to the weight percentage of silicon is in the range of 1.8 to 2.0.

3. The steel alloy of claim 1, comprising:
1.0 to 2.0% vanadium.

4. The steel alloy of claim 3, comprising:

5. The steel alloy of claim 4, comprising:
0.7 to 0.9% silicon.
1.4 to 1.6% aluminum.

6. The steel alloy of claim 5, comprising:
0.8 to 1.0% carbon.

7. The steel alloy of claim 1, comprising:
0.65 to 0.75% carbon.

8. The steel alloy of claim 7, comprising:
0.7 to 0.9% silicon; and
1.4 to 1.6% aluminum.

9. The steel alloy of claim 1, comprising:
0.4 to 0.6% vanadium.

10. The steel alloy of claim 9, comprising:
0.7 to 0.9% silicon; and
1.4 to 1.6% aluminum.

11. The steel alloy of claim 1, further comprising fine, uniform carbide structures.

12. The steel alloy of claim 11, wherein the fine, uniform carbide structures are substantially round shaped and free of internal cracks.

13. A steel alloy, consisting essentially of: by weight,
0.5 to 1% carbon;
0.4 to 1.5% vanadium;
1.4 to 2.0% aluminum;
0.2 to 1.0% silicon;
3.5 to 4.5% chromium;
0.1 to 0.5% manganese;
3.5 to 4.5% molybdenum;
less than 0.05% nitrogen; and
iron, wherein the ratio of weight percentage of aluminum to the weight percentage of silicon is in the range of 1.7 to 2.2.

14. The steel alloy of claim 13, wherein the ratio of weight percentage of aluminum to the weight percentage of silicon is in the range of 1.8 to 2.0.

15. The steel alloy of claim 13, consisting essentially of:
0.7 to 0.9% silicon.

16. The steel alloy of claim 15, consisting essentially of:
1.4 to 1.6% aluminum.

17. The steel alloy of claim 13, consisting essentially of:
0.65 to 0.75% carbon.

18. The steel alloy of claim 17, consisting essentially of:
0.7 to 0.9% silicon; and
1.4 to 1.6% aluminum.

19. The steel alloy of claim 13, consisting essentially of:
0.4 to 0.6% vanadium.

20. The steel alloy of claim 19, consisting essentially of:
0.7 to 0.9% silicon; and
1.4 to 1.6% aluminum.

21. An article of manufacture, comprising:
0.5 to 1% carbon;
0.4 to 2.0% vanadium;
1.4 to 2.0% aluminum;
0.2 to 1.0% silicon;
3.5 to 4.5% chromium;
3.5 to 4.5% molybdenum;
0.1 to 0.5% manganese; and
iron, wherein the ratio of weight percentage of aluminum to the weight percentage of silicon is in the range of 1.7 to 2.2.

22. The article of manufacture of claim 21, wherein the ratio of weight percentage of aluminum to the weight percentage of silicon is in the range of 1.8 to 2.0.

23. The article of manufacture of claim 21, comprising:
1.0 to 2.0% vanadium.

24. The article of manufacture of claim 23, comprising:
0.7 to 0.9% silicon.

25. The article of manufacture of claim 24, comprising:
1.4 to 1.6% aluminum.

26. The article of manufacture of claim 25, comprising:
0.8 to 1.0% carbon.

27. The article of manufacture of claim 26, comprising:
0.65 to 0.75% carbon.

28. The article of manufacture of claim 27, comprising:
0.7 to 0.9% silicon; and
1.4 to 1.6% aluminum.

29. The article of manufacture of claim 25, comprising:
0.4 to 0.6% vanadium.

30. The article of manufacture of claim 22, comprising:
0.7 to 0.9% silicon; and
1.4 to 1.6% aluminum.

31. The article of manufacture of claim 21, wherein the article of manufacture is selected from a metalworking tool, a bearing, a gear, a specialized automotive part, a camshaft, and a lifter.

32. The article of manufacture of claim 21, further comprising fine, uniform carbide structures.

33. The article of manufacture of claim 32, wherein the fine, uniform carbide structures are substantially round shaped.

* * * * *